United States Patent [19]

Suzuki et al.

[11] Patent Number: 4,547,147

[45] Date of Patent: Oct. 15, 1985

[54] COMBUSTION DEVICE FOR A CAR

[75] Inventors: Hiroyoshi Suzuki, Himeji; Shoichi Washino, Suita, both of Japan

[73] Assignee: Mitsubishi Denki Kabushiki Kaisha, Tokyo, Japan

[21] Appl. No.: 615,551

[22] Filed: May 31, 1984

[30] Foreign Application Priority Data

Jun. 30, 1983 [JP] Japan ..... 58-120838

[51] Int. Cl.[4] ..... F23Q 3/00

[52] U.S. Cl. ..... 431/265; 431/351

[58] Field of Search ..... 431/264, 265, 351

[56] References Cited

U.S. PATENT DOCUMENTS

| | | | |
|---|---|---|---|
| 2,221,519 | 11/1940 | Jones et al. | 431/265 |
| 3,223,136 | 12/1965 | Mutchler | 431/265 |
| 3,733,169 | 5/1973 | Lefebvre | 431/265 |
| 3,868,211 | 2/1975 | La Haye et al. | 431/351 |

OTHER PUBLICATIONS

"Diesel Particulate Trap Regeneration Techniques", W. R. Wade et al., SAE Paper No. 810118, pp. 16 to 20.

"Thermal and Catalytic Regeneration of Diesel Particulate Traps", W. R. Wade, et al., SAE Paper No. 830083, pp. 64 and 65.

*Primary Examiner*—Carroll B. Dority, Jr.

*Attorney, Agent, or Firm*—Oblon, Fisher, Spivak, McClelland & Maier

[57] ABSTRACT

A combustion device for a car comprises a fuel-atomizing nozzle for atomizing and injecting fuel, a combustion tube extending along said nozzle in the direction of injection of fuel, a coaxial airstream supplying passage extending along the outer circumference of said fuel-atomizing nozzle, an orifice means for fuel mixture formed near the inlet of said combustion tube and at the lower side of said fuel-atomizing nozzle, an ignition plug placed between said orifice means and said fuel-atomizing nozzle, and a lower airstream supplying passage which has at least one aperture opened to said combustion tube and is placed below said fuel-atomizing nozzle.

5 Claims, 5 Drawing Figures

COMBUSTION DEVICE FOR A CAR

BACKGROUND OF THE INVENTION

The present invention relates to an exhaust gas purifying device for a diesel engine. More particularly, it relates to a combustion device such as a regenerative burner for a car which performs heating, burning and removing fine particles, in exhaust gas, deposited on a filter to eliminate the clogging of the filter.

The particles contained in exhaust gas discharged from cars such as diesel engines are harmful to a human body and lawful restrictions on the amount of fine particles dishcarged from the diesel engines have been considered or executed in many countries.

Various measures have been proposed to reduce the amount of discharged fine particles. An effective way is, for example, placing a filter in the exhausting system of a diesel engine to catch fine particles thereon and then the filter is heated by a high temperature combustion gas ejected from a regenerative burner to burn the fine particles deposited on the filter, thereafter they are removed.

Problems imposed on the regenerative burner is that reliable, instant ignition should be attained as well as stable combustion and a satisfied combustion under a high burden should be attained in addition to miniaturization required for restriction of car space even under conditions of broad change in temperature and vibration load which are inherent in a car.

FIG. 1 is a sectional view showing an example of a conventional regenerative burner in which the reference numeral 1 designates a high pressure atomizing type or a twin fluid atomizing type nozzle, the numeral 2 refers to a whirling air supplying passage, the numeral 3 indicates upper whirling-air apertures, the numeral 3*a* denotes upper whirling-air fed from the apertures 3, the numeral 4 designates lower whirling-air apertures, the numeral 4*a* indicates lower whirling-air fed from the apertures 4, the numeral 5 indicates a pair of ignition plugs, the numeral 6 represents a combustion tube, the numeral 7 refers to flame produced by firing atomized fuel and the numeral 8 denotes a part of an exhaust pipe system of an engine.

In the device having the construction as above-mentioned, fuel or a primary fuel mixture atomized and ejected from the nozzle 1 is mixed with the upper whirling-air 3*a* fed through the upper whirling-air apertures 3, then is fired by means of the ignition plugs 5 to form the flame 7 in the combustion tube 6 through the agency of the lower whirling-air 4*a* fed from the lower whirling-air apertures, and thereafter combustion gas is led to a filter through the exhaust pipe 8.

The structure of the regenerative burner, however, has disadvantages of wearing of electrodes because the ignition plugs are always in contact with the flame 7 and of causing deterioration in firing property due to contamination of the ignition plugs with soot, tar and so on. There are further disadvantages that since the growth of the core of flame produced by firing is inhibited due to the cooling function of whirling-air which disturbs ambience around the electrodes of the ignition plugs 5, time required for totally firing, namely delay time in firing is prolonged and variation in the delay time of firing when the ratio of fuel to air is changed is also large.

In the burner having the construction as above-mentioned, although an attempt has been made to obtain a stabilized ignition surface by forming whirling-air streams, there takes place the drawback as follows. Since a force acts on the flame 7 in the directions of its center axis and the nozzle, the ignition surface is produced at a position very close to the nozzle and the upper whirling-air 3*a* causes a part of the flame 7 to contact with the nozzle to thereby deposit soot on the nozzle surface. Further, there takes place a temperature rise in the nozzle surface by thermal transmission and thermal radiation from the flame to thereby cause the fuel, remaining non-burned, deposited on the nozzle surface to form tar. The contamination of the nozzle by the accumulation of the soot, tar and other materials rapidly changes the area of the ejection opening of the nozzle and in the extreme case, the ejection opening may be clogged. Thus, in the conventional regenerative burner, it has been difficult to obtain a stable combustion through its life time due to, especially, occurence of the vapor lock of fuel in the nozzle which is caused by the temperature rise in the nozzle.

SUMMARY OF THE INVENTION

It is an object of the present invention is to provide an improved combustion device for a car to eliminate the disadvantages of the conventional device.

It is another object of the present invention to provide a combustion device equipped with a small-sized regenerative burner suitable for installing in a car which assures instant firing even though the ratio of fuel to air changes; reduces contamination by the deposition of soot and tar on a nozzle, ignition plugs and so on in long term use and provides a stable combustion.

The foregoing and the other objects of the present invention have been attained by providing a combustion device for a car which comprises a fuel-atomizing nozzle for atomizing and injecting fuel, a combustion tube extending along the nozzle in the direction of injection of fuel, a coaxial airstream supplying passage extending along the outer circumference of the fuel-atomizing nozzle, an orifice means for fuel mixture formed near the inlet of the combustion tube and at the lower side of the fuel-atomizing nozzle, an ignition plug placed between the orifice means and the fuel-atomizing nozzle, and a lower airstream supplying passage which has at least one aperture opened to the combustion tube and is placed below the fuel-atomizing nozzle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Several embodiments of the present invention will be described with reference to drawings.

Figure 1:
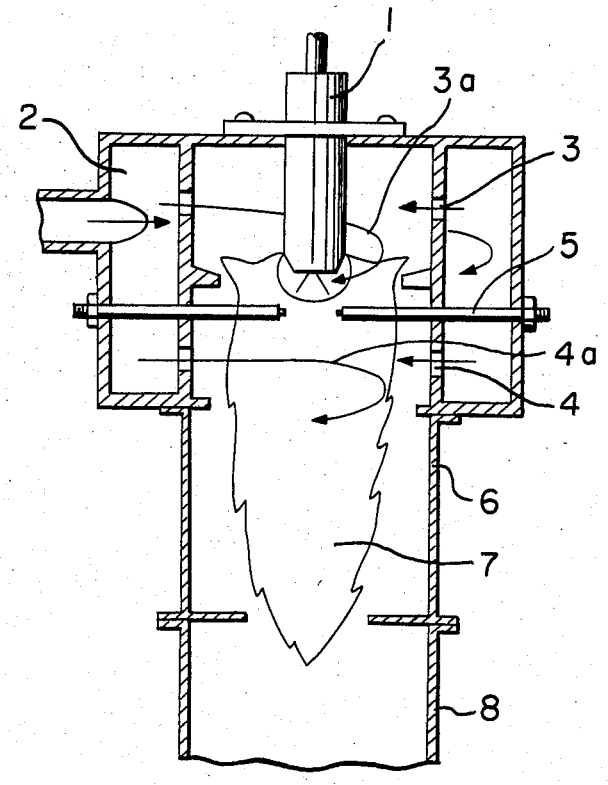
FIGURE 1 PRIOR ART
FIG. 1 is a longitudinally cross-sectional view of the conventional combustion device for a car.
Figure 2:
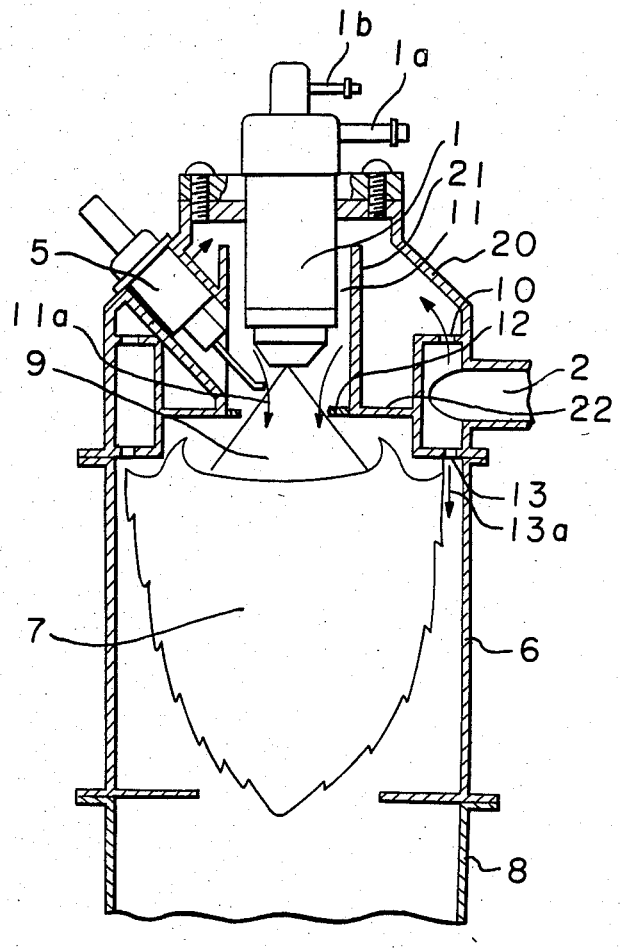
FIG. 2 is a longitudinally cross-sectional view of an embodiment of the combustion device for a car of the present invention.

FIG. 2 is a longitudinally corss-sectional view of an embodiment of the present invention in which a twin fluid type nozzle is used as a fuel-atomizing nozzle. In FIG. 2, the atomizing nozzle is provided with an air feeding pipe 1*a* and a fuel feeding pipe 1*b* to inject a stream of atomized fuel-air mixture 9. The atomizing nozzle 1 is surrounded by a casing 20 in which a whirling-air supplying passage 2 is formed. There is formed at least one upper air-supplying aperture 10 which is communicated with the whirling-air supplying passage 2 to direct air upwardly in the casing 20. A cylindrical wall 21 with both ends opened extends along the nozzle 1 with a gap therebetween to form an upper coaxial airstream supplying passage 11 so that air blown from the upper air-supplying aperture 10 flows downwardly through the passage 11. Air flowing through the upper coaxial airstream supplying passage 11 is designated by the reference numeral 11*a*. The lower end of the cylindrical wall 21 is connected to the casing 20 through a horizontal annular wall 22. An orifice 12 for fuel mixture is provided below the cylindrical wall 21 near the inlet of a combustion tube 6. The orifice 12 has an inner diameter sufficient to throttle the air from the upstream side but not to cause the impingement of the atomized fuel mixture 9 on it. A lower coaxial airstream supplying passage 13 is formed by at least one aperture which is communicated with the whirling-air supplying passage 2 and which opens in the combustion tube 6 at the downstream side of the orifice 12. A lower coaxial airstream blown from the passage 13 is designates by the numeral 13*a*. The electrode of the ignition plug 5 is placed near the atomized fuel mixture 9 and between the atomizing nozzle 1 and the orifice 12 so as not to contact with the atomized fuel mixture.

The operation of the regenerative burner constructed as above-mentioned will be described.

Fuel fed from the fuel feeding pipe 1*b* and air fed from the air feeding pipe 1*a* are mixed in the nozzle 1 and the fuel mixture is ejected as a stream of atomized fuel mixture 9 in the axial direction of the combustion tube 6. On the other hand, air passing through the whirling-air supplying passage 2 and the upper air-supplying aperture 10 is introduced to the upper coaxial air-supplying passage 11 formed around and along the outer circumference of the nozzle 1. The upper coaxial airstream 11*a* thus formed is mixed with the atomized fuel mixture stream 9 and goes therewith downwardly. When a discharging arc produced by the electrode of the ignition plug 5 and elongated by the function of the flow of the upper coaxial air 11*a* comes to contact with the atomized fuel mixture stream, a bluish core of flame is formed in a part of the atomized fuel mixture stream and the bluish core grows to flame 7 having its ignition surface at the downstream side of the orifice 12 for fuel mixture. The flame 7 is mixed with the lower coaxial airstream 13*a* blown from the lower coaxial air-supplying passage 13 to accomplish combustion in the combustion tube 6.

During the operation as above-mentioned, the ignition area of the flame 7 is formed in a stable manner because the flow rate of the atomized fuel mixture stream is balanced with the burning velocity of it at the central portion downstream of the orifice, while the flame accompanies a circulating stream formed by the upper and lower airstreams at the peripheral portion at the downstream side and in addition, the ignition surface is separated from the orifice 12 by suitably selecting the ratio of the speed of the lower airstream to the upper airstream. Accordingly, the flame 7 is not in contact with the nozzle 1, the ignition plug 5 and so on to minimize contamination of these parts with the soot and tar.

Further, since the electrode of the ignition plug 5 does not contact to the atomized fuel mixture stream and the nozzle 1 and ignition plug 5 is cooled by the upper coaxial airstream 11*a*, a temperature rise in the nozzle is small, contamination of these parts with soot and tar is prevented and the wearing of the electrode is small whereby ignition property and stable combustion property are not impaired.

In the regenerative burner of the present invention, the bluish core of the flame in the atomized fuel mixture stream produced by firing by means of the ignition plug 5 is not inhibited in its growth by virtue of the upper airstream 11*a* as a coaxial air flow. Further, drawbacks such as generation of white smoke at the initiation of combustion as the result of the inner portion of the burner being wet due to delay in ignition, acceleration of formation of tar and the discharge of fuel without burned to the outside are eliminated because the air-fuel mixture possess instant ignition property in a broad range from 1 to 2 in the fuel-air ratio.

Further, in the structure of the burner of the present invention, the position of the ignition surface of the flame 7 is substantially determined by the flow rates of the atomized fuel mixture stream 9 and the upper coaxial airstream 11*a* whereby it is possible to feed the lower coaxial airstream in conformity with the shape of the combustion tube 6 which is subjected to restriction for mounting in a car.

In the first embodiment of the present invention, the flow rate of the lower coaxial airstream 13*a* fed from the lower coaxial air-supplying passage 13 is suitably made greater than that of the upper coaxial airstream 11*a* whereby flame having a larger diameter and a small length is formed. Accordingly, a space in a combustion tube having a small length is efficiently utilized to thereby allow combustion of the burner having a small length under a high load in comparison with the burner having the same capacity.

Figure 3:
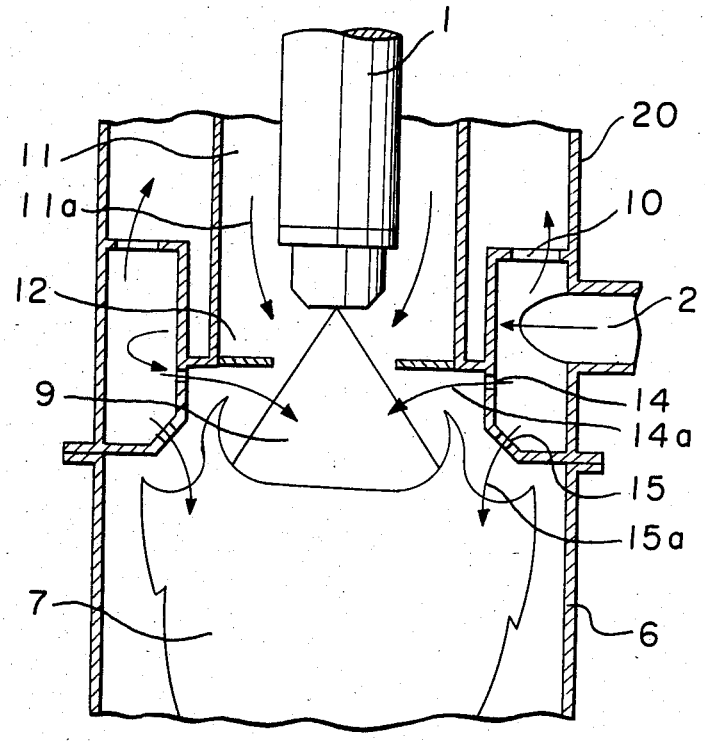
FIG. 3 is a enlarged longitudinally cross-sectional view of another embodiment of the combustion device of the present invention.

FIG. 3 is an enlarged cross-sectional view showing another embodiment of the burner according to the present invention. One or more number of air apertures 14 are formed in the casing 20 in the radial direction to supply a part of the lower coaxial airstream near the downstream of the orifice 12 for fuel mixture. That is, the air apertures 14 feeds air 14*a* inwardly in the direction substantially perpendicular to the atomized fuel mixture stream injected from the atomizing nozzle 1 to mix the air with the fuel mixture stream 9 and to feed them together. This embodiment of the present invention allows formation of the ignition surface of the flame spaced from the orifice and prevents the flame from entrance into the upstream side of the orifice even though the flow rate of the upper airstream 11*a* becomes small due to reduction in the air-fuel ratio. Further, although there is shown in the embodiment of FIG. 2 that a lower coaxial airstream is formed, it is possible to make the diameter of the flame small by feeding the lower airstream from lower whirling-air apertures 15 as a lower whirling-air stream 15*a*. In this case, efficiency of utilizing space for a combustion tube having a small diameter is high and the diameter of the burner can be small. In FIG. 3, it is needless to say that air is supplied as a coaxial airstream on the downstream side like the embodiment as shown in FIG. 2 when the length of the burner is to be shortened.

Figure 4:
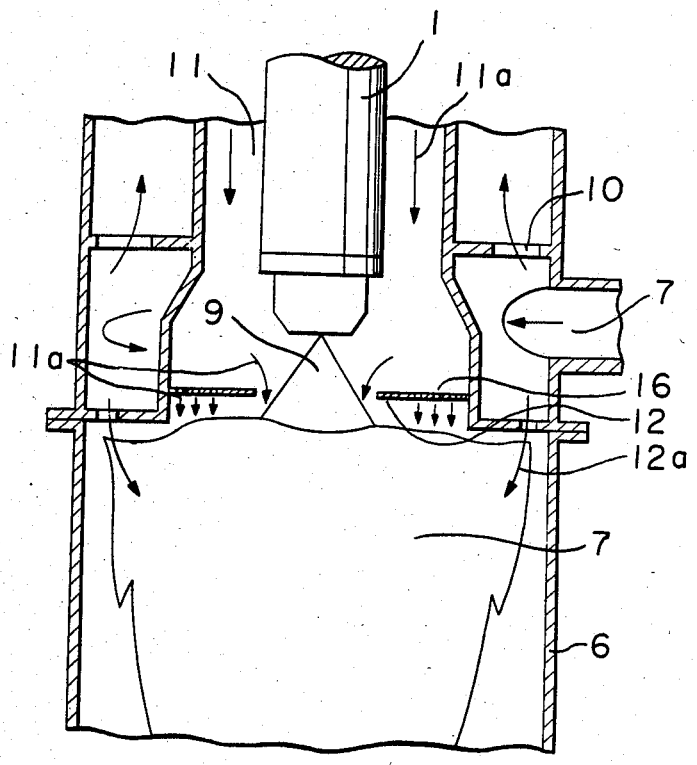
FIGS. 4 and 5 are respectively enlarged longitudinally cross-sectioinal views showing the other embodiments of the present invention.

FIG. 4 is an enlarged cross-sectional view showing still another embodiment of the present invention. In FIG. 4, a number of orifices 16 for fuel mixture, consisting of a number of small openings or slits, are formed at the downstream side of the nozzle 1 to feed a part of the upper coaxial airstream 11*a* to the combustion tube 6 through the small openings and so on. In the embodiment having the construction as above-mentioned, the ignition surface of the flame 7 is formed in a stable manner at the downstream of the orifice so as to be substantially equidistant from the orifice surface. Further, since mixing of the air fed through the small openings with the flame 7 is promoted, efficiency of utilizing space for the flame increases and a smaller combustion tube enabling combustion under a high load is obtainable.

Figure 5:
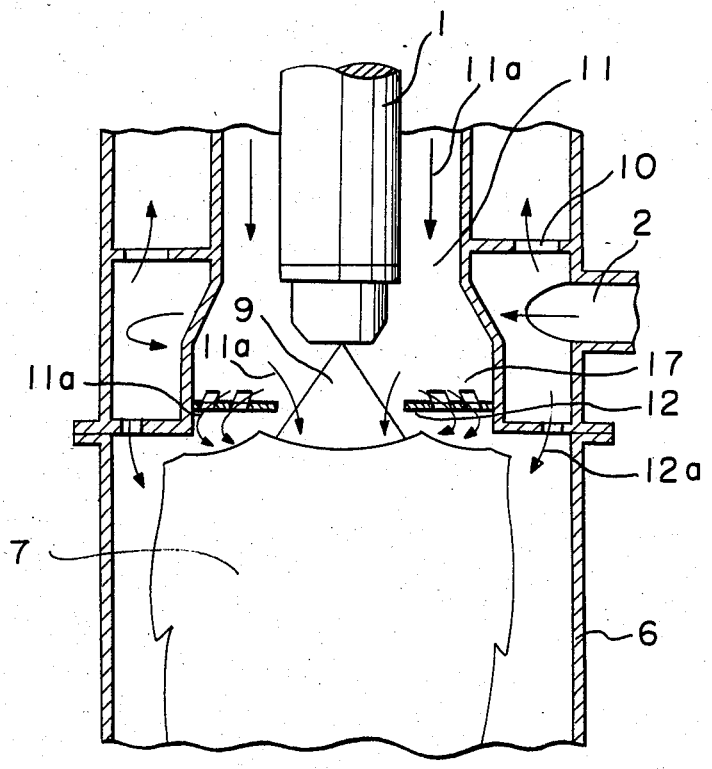

FIG. 5 shows further embodiment of the present invention in which there are provided orifices 17 with measures to positively whirl a part of the upper coaxial airsteam 11*a* so as to feed it in the combustion tube. In this case, the same effect as the foregoing embodiments can be expected.

In the description concerning all embodiments, the upper and lower airstream are supplied from a common whirling-air supplying passage 2; however, it is needless to say that the airstreams can be supplied from separate passages.

In the foregoing description, explanation has been made as to application of the present invention to a regenerative burner for an exhaust gas purifying device. However, the present invention is applicable to a heating device for a car.

As described above, in accordance with the present invention, contamination of device elements due to soot, tar and so on is reduced as compared with a combustion device for a car having the same capacity; a highly reliable device can be obtained by assuring stable firing and combustion and miniaturization of the device is possible.

Obviously, numerous modifications and variations of the present invention are possible in light of the above teachings. It is therefore to be understood that within the scope of the appended claims, the invention may be practiced otherwise than as specifically described herein.

We claim:

1. A combustion device for a car which comprises:

a fuel-atomizing nozzle for atomizing and injecting fuel, a combustion tube extending axially of said nozzle in the direction of injection of fuel, means forming a coaxial airstream supplying passage extending along the outer circumference of said fuel-atomizing nozzle, a substantially flat orifice plate for fuel mixture formed near the inlet of said combustion tube and at a lower side of said fuel-atomizing nozzle, an ignition means placed between said orifice plate and said fuel-atomizing nozzle, and means forming a lower airstream supplying passage which has at least one aperture opened with a downward component to said combustion tube and placed below said fule-atomizing nozzle, wherein said lower airstream supplying passage has at least one additional aperture comprising means to feed a part of said lower airstream in a radially inward direction and substantially along the lower surface of said orifice plate.

2. The combustion device for a car according to claim 1, wherein said at least one aperture for said lower airstream supplying passage is formed to feed air along the axial direction of said combustion tube.

3. The combustion device for a car according to claim 1, wherein said at least one aperture for said lower airstream supplying device is formed to feed a whirling airstream into said combustion tube.

4. The combustion device for a car according to claim 1, wherein said orifice plate has an inner diameter sufficient to prevent impingement of the fuel mixture stream from said fuel-atomizing nozzle on said orifice plate.

5. The combustion device for a car according to claim 1, including means providing the flow rate of air from said lower airstream supplying passage being greater than that of air from said coaxial air-supplying passage.

* * * * *